US008499588B2

(12) United States Patent
Kim et al.

(10) Patent No.: US 8,499,588 B2
(45) Date of Patent: Aug. 6, 2013

(54) APPARATUS FOR TREATING CLOTHING

(75) Inventors: Kyeong Hwan Kim, Seoul (KR); Soo Young Oh, Seoul (KR); Myong Hun Im, Seoul (KR); Woo Young Kim, Seoul (KR); Han Gil Park, Seoul (KR); Kyung Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 734 days.

(21) Appl. No.: 12/452,493

(22) PCT Filed: Jul. 2, 2008

(86) PCT No.: PCT/KR2008/003896

§ 371 (c)(1),
(2), (4) Date: Jan. 5, 2010

(87) PCT Pub. No.: WO2009/008622

PCT Pub. Date: Jan. 15, 2009

(65) Prior Publication Data

US 2010/0139334 A1 Jun. 10, 2010

(30) Foreign Application Priority Data

Jul. 6, 2007 (KR) ..... 10-2007-0067955
May 13, 2008 (KR) ..... 10-2008-0043876
May 13, 2008 (KR) ..... 10-2008-0043884

(51) Int. Cl.
*B08B 3/12* (2006.01)

(52) U.S. Cl.
USPC ..... 68/5 C

(58) Field of Classification Search
USPC ..... 8/149.3; 68/5 C, 5 R
See application file for complete search history.

(56) References Cited

U.S. PATENT DOCUMENTS 1,880,668 A 10/1932 Bassett
6,161,306 A * 12/2000 Clodic ..... 34/321

FOREIGN PATENT DOCUMENTS

| | | | |
|---|---|---|---|
| CN | 1534130 A | | 10/2004 |
| EP | 1 544 345 | | 3/2004 |
| EP | 1 469 120 | | 4/2004 |
| EP | 1 666 655 | | 7/2005 |
| JP | 2007111396 A | * | 5/2007 |
| KR | 100698132 | | 3/2007 |

OTHER PUBLICATIONS

Machine Translation of Uchiyama, JP 2007111396 A, May 2007.*

* cited by examiner

*Primary Examiner* — Michael Barr
*Assistant Examiner* — David Cormier
(74) *Attorney, Agent, or Firm* — McKenna Long & Aldridge LLP

(57) ABSTRACT

The present invention relates to a clothing treating apparatus. The clothing treating apparatus includes a cabinet, a clothing holding unit in the cabinet for holding clothing, and a steam generator for generating steam or superheated steam to supply to the clothing holding space, thereby permitting to remove rumples from the clothing and microbes from the clothing possible to remain thereon.

19 Claims, 7 Drawing Sheets

APPARATUS FOR TREATING CLOTHING

TECHNICAL FIELD

The present invention relates to an apparatus for treating clothing, more particularly, to an apparatus for treating clothing which can remove rumples, as well as microbes from clothing.

BACKGROUND ART

In general, in the clothing treating apparatuses, there are washing machines, dryers, washing and drying machines, an so on, and, recently, refreshers are developed for keeping clothing in a fresh state.

The clothing treating apparatuses have systems required for purposes, to require separate pressing for removing rumples from the clothing even if the clothing has been treated with respective apparatuses.

DISCLOSURE OF INVENTION

Technical Problem

That is, laundry washed with water by using the washing machine has rumples, and if the laundry is dried with the dryer, the rumples formed once are not removed completely during a drying process. Moreover, even in a case the clothing is stored after washing and drying, creases, rumples and folds are formed, to require a separate pressing for removing the rumples.

Furthermore, even if the clothing has been treated with the clothing treating apparatuses, it has been difficult to eliminate fungi liable to remain on the clothing, or fungi of athlete's foot liable to remain on socks, perfectly. In order to remove such fungi, though a high temperature environment of about 125° C. is required, it has been difficult to make a space the clothing is placed therein to be such a high temperature.

Technical Solution

Accordingly, the present invention is directed to an apparatus for treating clothing.

An object of the present invention is to provide an apparatus for treating clothing, which can prevent rumples from forming on clothing and/or remove rumples from the clothing.

Another object of the present invention is to provide an apparatus for treating clothing, which can provide a high temperature environment to a space clothing is stored therein for removing microbes liable to remain on the clothing.

Another object of the present invention is to provide an apparatus for treating clothing, which can be used conveniently and safely in homes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a clothing treating apparatus includes a cabinet, a clothing holding unit in the cabinet for holding clothing, and a steam generator for generating steam or superheated steam to supply to the clothing holding space.

The steam generator may include a steam chamber which forms a space for heating water to generate the steam, and a superheated steam chamber which forms a space for reheating the steam to generate the superheated steam. That is, the steam chamber for generating the steam, and the superheated steam chamber for generating the superheated steam may be spaces independent from each other, and a portion of the space of the steam chamber may be the space for generating the superheated steam.

Both the steam chamber and the superheated steam chamber have heaters respectively for heating. In this case, the heaters can be controlled independent from each other.

Of course, the steam chamber and the superheated steam chamber have single heater for both. In this instance, it is preferable that the single heater has a system in which a portion of the single heater provided at the steam chamber and a portion of the single heater provided at the superheated steam chamber are controlled independent form each other. That is, if the portion for the steam chamber of the single heater is heated, and the portion for the superheated steam chamber is heated depending of the heating of the steam chamber, only the superheated steam will be generated.

For an example, there is a case when supply of very high superheated steam to the clothing holding unit is not desirable. That is, of course, though sterilizing effect will be the greater as the steam temperature the higher, there is a possibility of damaging the clothing.

Therefore, it is preferable that use of the superheated steam and the steam can be selectively according to user's selection or a course of the clothing treating apparatus. As an example, the steam may be used for washing and sterilization of clothing of cotton, and the superheated steam which has a temperature higher than the steam can be used for washing and sterilization of the tub or the drum.

Along with this, it is preferable that the clothing treating apparatus further includes a pipe between the clothing holding unit and the steam generator to form a flow passage of the steam or the superheated steam. Of course, if the steam generator has a plurality of independent spaces, for an example, the steam chamber, the superheated steam chamber, and so on, the chambers are also connected with the pipes. In this case, the pipe connecting the steam chamber and the superheated steam chamber may also be included to the steam generator.

It is preferable that the steam generator and the flow passage are opened in a direction the steam or the superheated steam is supplied to the clothing holding unit. That is, it is preferable that elements, such as pressure valves for maintaining a pressure in the steam generator and the flow passage, are not provided. In other words, it is preferable that the steam or the superheated steam is supplied to the clothing holding unit at the atmospheric pressure by a pressure of the steam or the superheated steam itself generated at the steam generator.

Eventually, construction of the steam generator in a mode of a pressure vessel of a material, such as stainless steel, is not required. According to this, safe matters caused by a high pressure can be prevented in advance, and a production cost can be reduced, significantly.

In the meantime, the steam generator may include a housing having an inlet for introduction of water thereto for generating the steam, the steam chamber which forms a space in the housing for heating the water introduced thereto through the inlet to generate the steam, and a superheated steam chamber which forms a space in the housing for heating the steam introduced thereto through the steam chamber to generate the superheated steam.

Of course, in this case too, both the steam chamber and the superheated steam chamber have heaters respectively for heating.

The steam rises as the steam is generated as heated. Therefore, the superheated steam chamber may be provided on an upper side of the steam chamber space. Along with this, the heaters may be provided inside of the spaces of the chambers.

The superheated steam chamber may be on an upper side of the space of the steam chamber. That is, a lower side of the inside of the housing or the lower side and a portion of an upper side of the inside of the housing may be the steam chamber for generating the steam, and the upper side of the housing or a portion of the upper side of the housing may be the superheated steam chamber for reheating the steam to generate the superheated steam. In this case, it may be said that the superheated steam is generated as the steam is heated again before the steam is discharged form the inside of the housing.

In the meantime, the superheated steam chamber has an outer wall which separates the superheated steam chamber from the steam chamber. In this case, the steam is introduced to the superheated steam chamber through the communication holes in the outer wall, and the steam is heated to the superheated steam in the superheated steam chamber and discharged therefrom. According to this, a good quality steam can be generated.

It is preferable that the communication holes are formed in a portion of the outer wall of the superheated steam chamber adjacent to the heater in the superheated steam chamber, for enhancing heat exchange efficiency of the heater.

In the meantime, it is preferable that the outer wall of the superheated steam chamber has a long side arranged with a gap from an inner wall of the housing. Of course, an entire outer wall of the chamber may have a gap from the inner wall of the housing, a portion of the outer wall may be connected to, or in contact with, the inner wall of the housing for securing the superheated steam chamber to an inside of the housing, or forming an outlet of the superheated steam chamber.

In this instance, there is steam present in the gap. According to this, direct transmission of a high temperature from the superheated steam chamber to the inner wall of the housing is prevented by the gap and the steam. Therefore, even if the superheated steam is generated in the superheated steam chamber, a temperature of an outside of the housing rises not so much. Accordingly, the superheated steam can be generated, safely.

The housing may have at least one fastening hole for placing in and fastening the superheated steam chamber thereto. In this case, after the housing and the superheated steam chamber are fabricated separately, the superheated steam chamber may be mounted to an inside of the housing with the fastening holes. Accordingly, the steam chamber and the superheated steam chamber spaced from the steam chamber can be mounted in the housing, easily. Along with this, the fastening holes enable easy securing of the heater.

In the meantime, the steam chamber and the superheated steam chamber may be arranged side by side in a horizontal direction. In this instance, the heater is provided on a lower side of the steam chamber and the superheated steam chamber for heating respectively, and the heater is a single plate heater.

The heater includes three electric contact points for heating the steam chamber and the superheated steam chamber independent from each other.

The clothing treating apparatus may further include a heat exchanger in the superheated steam chamber. The heat exchanger guides the steam introduced to a top of the superheated steam chamber to a lower side of the superheated steam chamber, and guides the steam to an upper side of the superheated steam chamber again. That is, if the heater is located on the lower side of the superheated steam chamber, it is for adequate heat exchange of the steam with the heater.

It is preferable that the clothing treating apparatus further includes a pipe for supplying the steam or the superheated steam generated at the steam generator to the clothing holding unit.

The pipe may also be provided between the steam chamber and the superheated steam chamber. In this case, it is preferable that the steam chamber and the superheated steam chamber are spaced from each other, and connected with the pipe.

The superheated steam chamber is formed at one section of the pipe. Along with this, the clothing treating apparatus may further include a fan mounted to the superheated steam chamber or the pipe for smooth flow of the steam or the superheated steam.

It is to be understood that both the foregoing general description and the following detailed description of the present invention are exemplary and explanatory and are intended to provide further explanation of the invention as claimed.

Advantageous Effects

As has been described, the clothing treating apparatus of the present invention has the following advantages.

The steam spray permits effective prevention or removal of formation of creases or rumples.

The spray of the superheated steam generated by reheating the steam permits perfect sterilization of fungi of athlete's foot and fungi which can not be sterilized with general steam.

Along with this, selective use of the steam or the superheated steam is permitted and safe and convenient use of a clothing treating apparatus in home is permitted.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

In the meantime, in describing embodiments of the present invention, though a washing machine is described as an example of the clothing treating apparatus, the clothing treating apparatus of the present invention is not limited to this, but the present invention is applicable to apparatuses that treat clothing, appropriately. That is, present invention is applicable to, starting from the washing machines, dryers, and washing and drying machines, and even to refresher that maintains clothing fresh.

Therefore, a clothing holding portion for holding clothing can be a drum of a general drum type washing machine or a drum type dryer, and a space in a cabinet for holding clothing in a case of a cabinet type dryer, or refresher, or the like.

Figure 1:
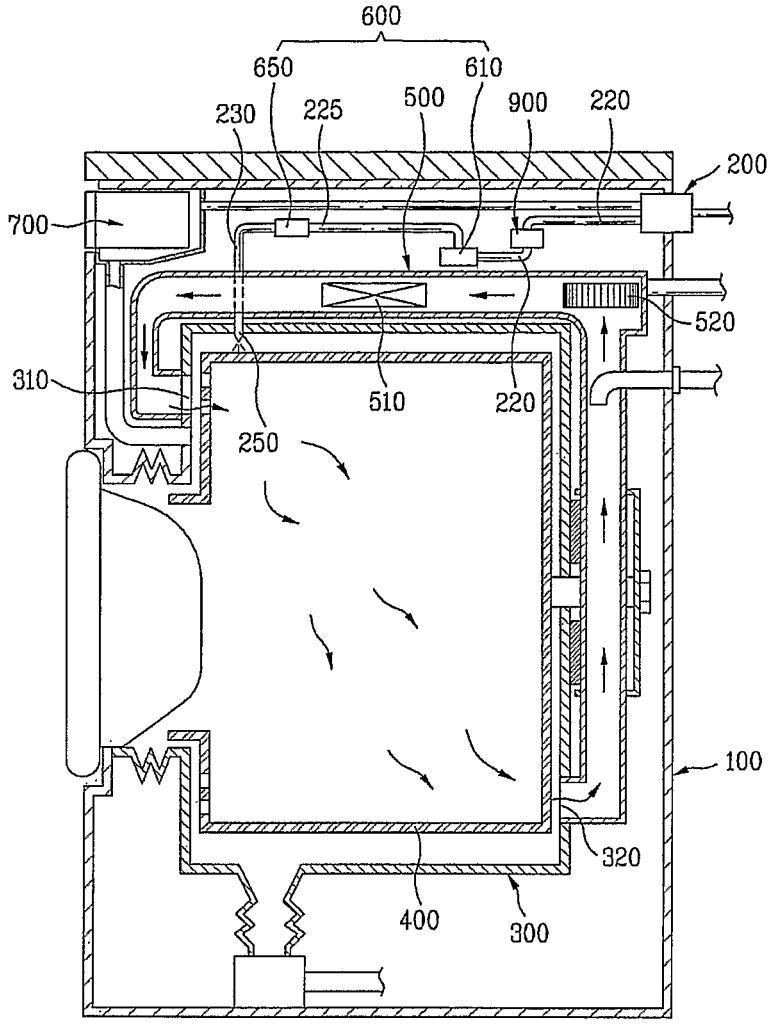
FIG. 1 is a longitudinal section illustrating a clothing treating apparatus in accordance with a preferred embodiment of the present invention.

FIG. 1 is a longitudinal section illustrating an inside of a washing machine in accordance with a preferred embodiment of the present invention.

Referring to FIG. 1, the washing machine of the embodiment includes a cabinet 100 which is an exterior of the washing machine, a tub 300 in the cabinet 100, a drum 400 rotatably mounted in the tub 300.

At one side of the cabinet 100, there is a water supply valve 200 for supplying water to the washing machine. A portion of the water supplied through the water supply valve 200 is supplied to a detergent box 690 and therefrom to the tub 300 together with detergent, and rest of the water can be filtered through a water softening unit 900 and supplied to the steam generator 600. That is, it is preferable that a flow passage for supplying the water to the tub through the detergent box and a flow passage for supplying the water for generating the steam are separated from each other.

The steam generator 600 of the present invention generates steam for supplying to the drum, or reheats the steam to generate superheated steam. The steam generator 600 heats the water supplied thus to generate and supply steam to the drum 400, or reheats the steam generated thus selectively to supply superheated steam to the drum 400. The steam once generated is reheated to generate the superheated steam for removal of various microbes from washing objects, as well as from the tub or drum.

The steam generator 600 will be described in detail, later.

In the meantime, in a case of a washing and drying machine, the washing and drying machine has a hot air inlet 310 in one side of the tub 300 for supplying hot air from a drying heater 510 to the tub 300, and a hot air outlet 320 in the other side of the tub 300 for discharging air from the tub 300. The air heated at the drying heater 510 flows along a drying duct 500 which forms a flow passage between the hot air outlet 320 and the hot air inlet 301, and is circulated through the tub 300 and the drum 400 by a fan 520 in the drying duct 500.

Steam generators applicable to the present invention will be described in detail with reference to the drawings.

The steam generator in accordance with a preferred embodiment of the present invention will be described.

The steam generator 600 of the embodiment includes a steam generating unit 610 for heating water to generate steam, and reheating unit 650 for reheating the steam generated at the steam generating unit 610 for generating superheated steam.

The steam generating unit 610 has a steam chamber which is a space for heating the water to generate the steam, and the reheating unit 650 has a superheated steam chamber which is a space for reheating the steam generated at the steam chamber to generate the superheated steam.

Therefore, the steam is generated at first, and the steam is reheated to generate the superheated steam. In a case the steam is not introduced to the superheated steam chamber for reheating, the steam may be supplied to the drum or the tub. Therefore, it is preferable that the reheating unit 650 is put into operation selectively according to user's request, or necessity.

The steam generating unit 610 will be discussed at first, and then, the reheating unit 650 will be discussed.

Figure 2:
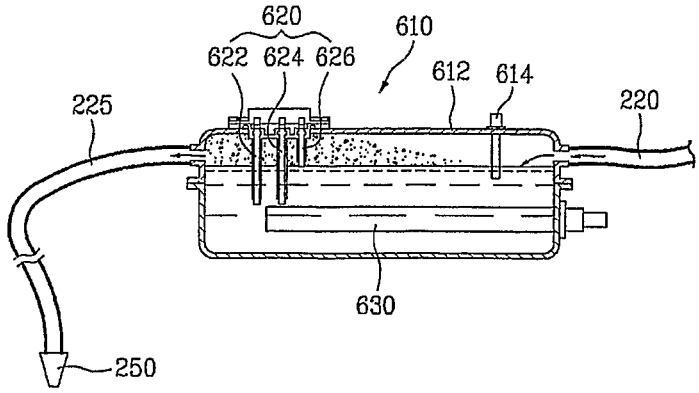
FIG. 2 is a perspective view illustrating the steam generator in FIG. 1.

FIG. 2 is a longitudinal section illustrating the steam generator 610 in accordance with a preferred embodiment of the present invention.

Referring to FIG. 2, the steam generating unit 610 includes a water tank 612 or housing for holding water, a heater 630 in the housing 612, a water level sensor 620 for measuring a water level of the steam generator 610, and a temperature sensor 614 for measuring a temperature of the steam generating unit 610. In general, the water level sensor 620 has a common electrode 622, a low level electrode 624, a high level electrode 626, for sensing a high water level or a low water level depending on conduction between the common electrode 622 and the high water level electrode 626, or between the common electrode 622 and the low water level electrode 624.

The steam generating unit 610 has a water supply hose 220 connected to one side for supplying water. It is preferable that the steam hose 225 passes through the reheating unit 650 which will be described later and has a steam spray unit 250 at a fore end. For connection to the water supply hose 220, a water supply hole 615 is formed in the steam generating unit 610, and for connection to the steam hose 225, a discharging hole 616 is formed in the steam generating unit 610. Through the discharging hole 616, the steam or, though will be described later, the superheated steam can be discharged, selectively. In general, the water supply hose 220 has one end connected to an external water supply source, such as a water tap, and the steam spray unit 250, i.e., the steam discharge hole, is located at a predetermined location of the drum 400 (see FIG. 1), for spraying the steam into the drum 400.

Of course, there can be a variety of locations of the steam spray unit 250. For an example, in the case of a dryer, the steam spray unit may be mounted to a drum back cover (not shown) which covers a rear side of the drum for rotatably supporting the drum. In a case of the washing machine, since the drum rotates, the steam spray unit 250 may be mounted to a gasket (not shown) which is provided for preventing water from leaking between the tub and the cabinet. Therefore, in any case, the steam or the superheated steam can be sprayed into the drum directly in both of the cases.

Referring to FIG. 1, the steam spray unit 250 may be located on an upper side of the tub. That is, even though the steam or the superheated steam is sprayed into the tub, it is possible to supply the steam or the superheated steam into the drum through a general pass through hole (not shown) in an outside wall of the drum.

In any case, it is preferable that the steam or the superheated steam is not a heat source for heating the water in the cabinet. That is, it is preferable that the steam or the superheated steam is a heat source for heating the cabinet space or the washing object, directly. Therefore, in order to supply the steam or the superheated steam to the drum or the tub uniformly, it is preferable that the location of the steam spray unit 250 is at the upper side of the drum or tub for spraying the steam downward.

In the meantime, the steam spray unit 250, in a nozzle shape, may have a cross section smaller than the steam hose 225. However, if the steam hose 225 has a small cross section, the steam spray unit 250 may be an end of the steam hose 225 through which the steam is discharged, merely.

If the water is supplied through the water supply hose 220 to the steam generating unit 610, a water level is determined with the water level sensor 620, and the water is supplied to the high water level. Once the water is supplied to the high water level, the water is heated with the heater 630 to generate the steam. The steam generated thus is supplied to the drum 400 through the steam hose 225 and the steam spray unit 250. In the meantime, in a case the water is heated as above, the temperature sensor 614 measures an inside temperature of the steam generating unit 610, and if the inside temperature of the steam generating unit 610 rises higher than a preset temperature, the heater 630 is turned off. If the water in the water tank 612 is reduced due to the steam generation to lower the water level, the water level sensor 620 senses the water level, to supply the water through the water supply hose 220, again.

In the meantime, the steam generated by heating the water thus is in general at 100° C. which is a boiling point of water. If the steam is supplied to the drum 400, clothing can be sterilized in the step before the water supply, if sprayed together with the water supply, an effect can be expected in which wetting of the clothing can be improved along with the sterilization. The effect of sterilization can be expected even if the steam is sprayed during washing, and also can be expected even if the steam is sprayed during rinsing, spinning, or drying after the washing. If a small amount of the steam is sprayed before or after drying, an effect is provided, in which rumples can be removed from laundry together with sterilization of the laundry.

The steam also elevates a temperature of the laundry or a drum space, to promote activity of the detergent and soak contaminant effectively. Therefore, as the steam can elevate a temperature of a washing space and the laundry without heating the washing water, effects, such as energy saving, washing performance improvement, and so on also can be expected.

Though general sterilizing effect can be expected from the steam spray, perfect sterilization can not be expected for microbes 100° C. steam fails to sterilize. For an example, fungi of athlete's foot which can be on socks, or fungi on clothing in a humid environment can not be sterilized at 100° C., but are known to be sterilized at 120° C. Therefore, even if the 100° C. steam is sprayed to the fungi of athlete's foot on socks, or fungi on clothing, the perfect sterilization fails.

Eventually, the steam generator 600 (see FIG. 1) further includes the reheating unit 650 (see FIG. 1) for heating the steam generated at the steam generating unit 610 again to generate the superheated steam. The superheated steam is defined as steam having a temperature higher than 110° C. in a steam state, preferably higher than 120° C. In the present invention, because the superheated steam having a temperature higher than 120° C. is sprayed into the drum 400, the fungi of athlete's foot or fungi on clothing which can remain on clothing in the drum 400 can be sterilized perfectly.

Referring to FIG. 1, it is preferable that the reheating unit 650 is above the steam generating unit 610. Because the steam generated at the steam generating unit 610 tends to rise, this is for smooth flow of the steam.

Referring to FIG. 1 again, it is preferable that the reheating unit 650 is located adjacent to the drum 400 between the steam generating unit 610 and the drum 400 which forms a holding space. That is, if the superheated steam reheated at the reheating unit 650 flows a comparatively long distance along the steam hose for supply to the tub 300 and the drum 400, there can be cases when the temperature of the superheated steam drops down below 120° C. or condenses. Therefore, in order to prevent the superheated steam from cooling down or condensing, it is preferable that the reheating unit 650 is located adjacent to the tub 300 and the drum 400 to which the superheated steam is supplied, rather than the steam generating unit 610. The embodiment suggests the reheating unit 650 is located adjacent to the drum 400 in the middle of a flow passage, i.e., the steam hose 225, connected between the steam generating unit 610 and the holding space of the drum 400.

The reheating unit 650 of the present invention will be described with reference to the attached drawing.

Figure 3:
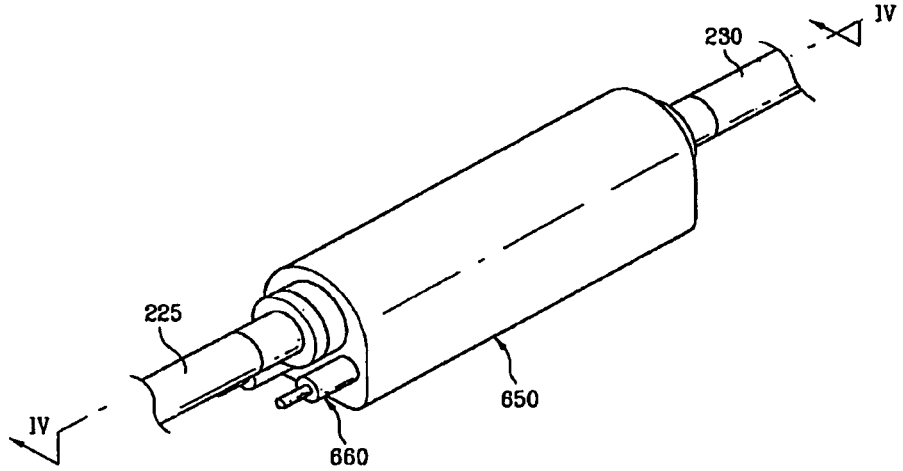
FIG. 3 is a perspective view illustrating a reheater in FIG. 1 in accordance with a first preferred embodiment of the present invention.
Figure 4:
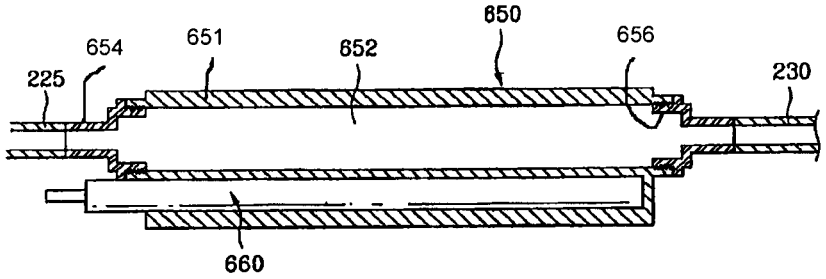
FIG. 4 is a sectional view across a line IV-IV in FIG. 3.

FIG. 3 is a perspective view illustrating a reheater 650 in accordance with a first preferred embodiment of the present invention, and FIG. 4 is a sectional view across a line IV-IV in FIG. 3.

Referring to FIGS. 3 and 4, the reheating unit 650 of the embodiment is arranged along the steam hose 225 which is a flow passage of the steam from the steam generating unit 610 (see FIG. 2), and includes a heating unit 651 for reheating the steam flowing along an inside of the steam hose 225.

In detail, the heating unit 651 has a tubular shape having a flow space 652 for flow of the steam. That is, since the steam is turned into the superheated steam in the flow space, the flow space may be called as a superheated steam chamber. It is preferable that the heating unit 651 is formed of a material having high heat conductivity, such as aluminum, possibly by die casting.

In the meantime, at one side of the heating unit 651, there is a heater 660 for reheating the steam. Though direct heating of the steam with the heater 660 is possible, the heater 660 may be buried along a surface of the heating unit 651 so that the heating unit 651 is heated with the heater 660 to heat the steam in the heating unit 651 along an inside circumferential surface of the heating unit 651. In this case, it is preferable that the heater 650 is a sheath heater molded in the heating unit 651 around the flow passage 652 of the heating unit 651 for rapid heating of the steam flowing through the flow space 652.

That is, the heater 660, buried in the heating unit 651, heats the heating unit 651 itself of aluminum rapidly as the heater 660 generates the heat, to reheat the steam flowing through the flow passage 652 of the heating unit 651 rapidly, to generate the superheated steam. According to this, if an entire inside circumferential surface of the heating unit 651 is heated, better heating efficiency can be expected than a case the heater 660 is exposed because a heating area becomes greater in comparison to a case the heater 660 is exposed.

In the meantime, the tubular shape of the heating unit 651 also forms a tubular flow passage 652 in the heating unit 651. Formed on opposites sides of the heating unit 651, there are an inlet 654 for introduction of the steam thereto and an outlet 656 for discharge of the superheated steam. In this case, it is preferable that the flow passage 652 of the heating unit 651 has a cross section greater than a cross section of the steam hose 225, so that steam supply to the flow passage 652 of the heating unit 651 and superheated steam discharge from the flow passage 652 is smooth.

Though not shown in the drawing, it is preferable that the heating unit 651 has a temperature sensor (not shown). The temperature sensor measures a temperature of the heating unit 651, to measure a temperature of the steam. By this, in a case the heating unit 651 is out of order, to elevate or drop the temperature of the heating unit 651 abnormally, the case may be informed to the user or the heater may be turned off by using a control unit (not shown).

In this instance, the reheating unit 650 may be used as the steam generating unit 610. That is, the reheating unit 650 may be connected in series, to use the reheating unit in a front side as the steam generating unit, and the reheating unit in a rear side as the superheated steam generating unit. In this case, the inlet 654 of the reheating unit 650 at a front end will serve as a water supply hole for supplying water required for steam generation, and the steam will be discharged through the outlet 656.

In any case, it is preferable that a capacity of the heater for generation of the steam, and a capacity of the heater for generation of the superheated steam are different from each other. Because a large capacity heater is required for generating the steam by heating the water taking a heat capacity of the water and vaporizing heat of the water into account, and a small capacity heater is required for turning the steam into the superheated steam taking a heat capacity of the steam into account. Therefore, taking those matters into account, the capacity of the heater for generation of the superheated steam may be selected to be ¼ to ⅕ of the capacity of the heater for generation of the steam.

In the meantime, according to the embodiment of FIG. 3, the reheating unit 650 reheats the steam during the steam is flowing, to generate the superheated steam. However, the heating during flowing of the steam is liable to have poor heat transfer efficiency. Therefore, if the steam is heated during the steam is stored, such that the steam does not flow, more efficient heating of the steam is possible. A reheating unit in accordance with a second preferred embodiment of the present invention will be described, in which the steam is stored for reheating.

Figure 5:
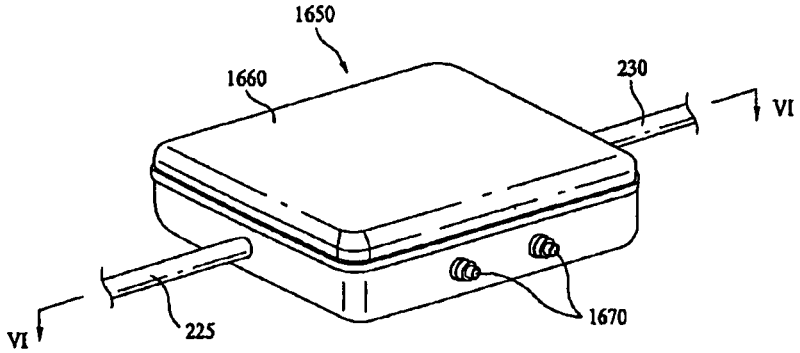
FIG. 5 is a perspective view illustrating a reheater in FIG. 1 in accordance with a second preferred embodiment of the present invention.
Figure 6:
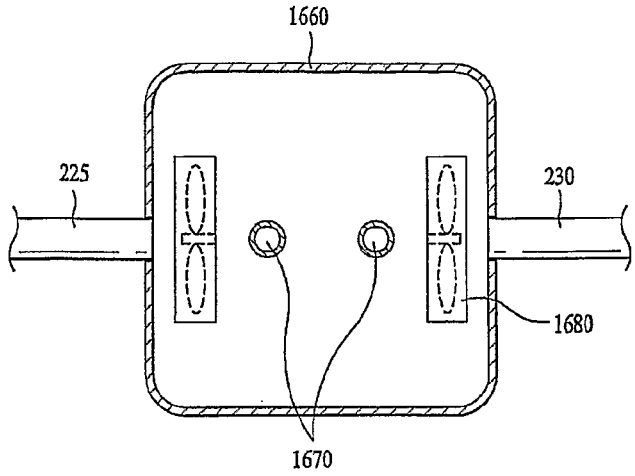
FIG. 6 is a sectional view across a line IV-IV in FIG. 5.

FIG. 5 is a perspective view illustrating a reheater 1650 in accordance with a second preferred embodiment of the present invention, and FIG. 6 is a sectional view across a line IV-IV in FIG. 5.

Referring to FIGS. 5 and 6, the reheating unit 1650 of the embodiment includes a case or a housing 1660 having a holding space for holding the steam from the steam hose 225 and a heater 1670 for reheating the steam in the housing 1660 for generating the superheated steam. Therefore, the housing 1660 forms a superheated steam chamber for generating the superheated steam.

It is preferable that the housing 1660 is an enclosed container for holding the steam to prevent the steam from leaking. Therefore, It is preferable that the housing 1660 has opening/closing devices (not shown), such as valves, at an inlet 1662 for supplying the steam and at an outlet 1664 for discharging the superheated steam respectively, for selective opening/closing of the housing 1660.

Accordingly, in the embodiment, if the steam is supplied to the housing 1660 through the steam hose 225 and the inlet 1662, the valves (not shown) at the inlet 1662 and the outlet 1664 are closed to enclose the housing 1660, the steam is reheated with the heater 1670. In this case, though not shown, it is preferable that a compressor or the like is further provided for elevating an inside pressure of the housing 1660. That is, while the steam in the housing 1660 is reheated with the heater 1670, if the inside pressure of the housing 1660 is elevated, a steam temperature of the housing 1660 can be elevated more easily to make the steam to a superheated state.

A process for generating the superheated steam will be described with reference to a T-S diagram.

Figure 7:
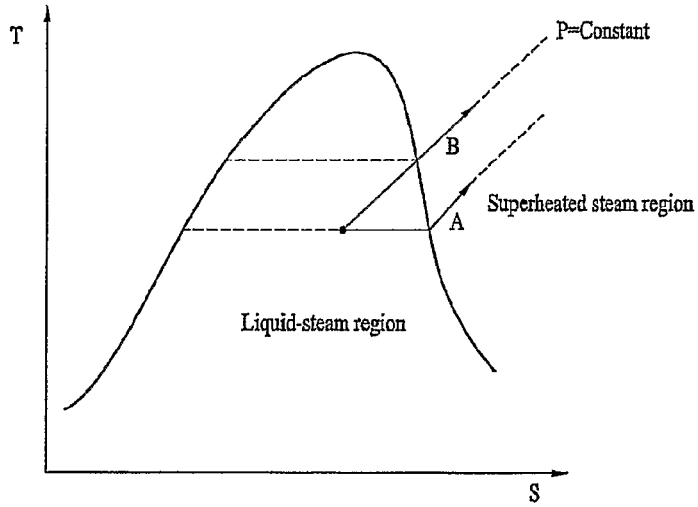
FIG. 7 is a graph illustrating a T-S diagram of steam supplied from the steam generator in FIG. 1.

FIG. 7 is a graph illustrating a T-S diagram of steam supplied from the steam generator in FIG. 1.

Referring to the T-S diagram in FIG. 7, if the water in the steam generating unit 610 (see FIG. 1) is heated to generate the steam, liquid and vapor coexist as the steam and the water exist together in the steam generating unit, which falls on a 'liquid-steam region' within a curve. Then, if the steam is heated with the reheating unit 650 (see FIG. 1), a state of equilibrium proceeds from the liquid-steam region within the curve to a 'superheated steam region' along an A path. In the meantime, if a pressure is applied to the steam at the same time with heating the steam, the state of equilibrium proceeds to the 'superheated steam region' along a B path, to reach to the superheated state, more easily.

Alike the embodiment in FIG. 3 described before, the embodiment may be provided with a temperature sensor (not shown). Since the sensing and control by using the temperature sensor is similar to the embodiment in FIG. 3, detailed description of the sensing and control will be omitted.

In the meantime, referring to FIGS. 5 and 6 again, in the embodiment, since the steam is heated with the steam held and stored in the holding space of the housing 1660, it is preferable that moving means is provided for moving the steam superheated by reheating. Accordingly, it is preferable that a fan 1680 is provided for moving the superheated steam from the housing 1660. The fan 1680 can be mounted to any location which enables the fan 1680 to discharge the superheated steam through the outlet 1664, preferably before or after the heater 1670 along a flow passage of the steam. Though FIG. 6 illustrates that the fan 1680 is mounted both to a front and a rear of the heater 1670, the fan 1680 may be mounted either to the front or the rear of the heater 1670 only.

If the fan 1680 is provided to the reheating unit 1650 for moving the superheated steam, easier supply of the superheated steam to the drum 400 (see FIG. 1) is possible. If the superheated steam is supplied by using the fan 1680, the superheated steam can be sprayed through the steam spray unit 250 (see FIG. 1) at a comparatively fast speed, enabling adequate contact of the superheated steam to the clothing in the drum 400, the sterilizing effect can be maximized.

In the meantime, as described before, it is preferable that the reheating unit 1650 is located adjacent to the drum 400, in detail, adjacent to the steam spray unit 250 which sprays the superheated steam or the steam to the drum 400. As described before, this is because the flow of the superheated steam along the steam hose 225 enables to prevent the superheated steam from cooling down or condensing until the superheated steam is sprayed into the drum 400 by minimizing a moving distance of the superheated steam.

Figure 8:
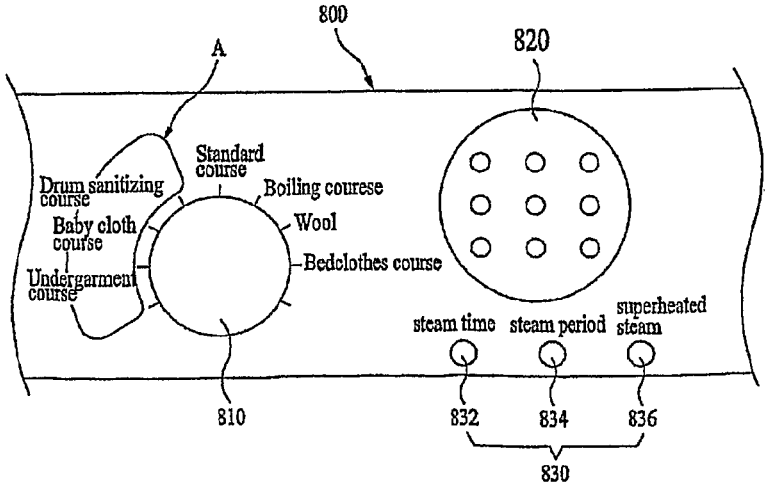
FIG. 8 is a front view illustrating a control panel of a clothing treating apparatus in accordance with a preferred embodiment of the present invention.

FIG. 8 is a front view illustrating a control panel 800 of a washing machine in accordance with a preferred embodiment of the present invention.

Referring to FIG. 8, the control panel can be mounted to a front of the washing machine in FIG. 1. The control panel includes a main selection unit 810 for selecting a course of the washing machine, and a sub-selection unit 830 for selecting a sub-function according to the course selected at the main selection unit 810.

The main selection unit 810 enables the user to make an appropriate selection depending on kind and amount of laundry the user intends to wash, wherein the course has a washing water amount, a temperature thereof, a number of rinsing times, a number of spinning times, and so on stored therein in advance defined as defaults. Therefore, if the user selects a course, the washing is carried out according to data defined as the defaults. The user may select the course, and in addition to this, may select the washing water amount, the temperature thereof, the number of rinsing times, the number of spinning times, and so on according to the course selected thus, on a manual selection unit 820 provided for above purpose.

In the meantime, the main selection unit 810 has at least one steam course for spraying the steam. The steam course may be, for an example, a baby clothing course, a drum sterilizing course, an undergarment course, and so on. That is, it the baby clothing or the undergarment is introduced and the baby clothing course, or the undergarment course is selected, the steam is sprayed at an appropriate time of washing, rinsing, or spinning. If the drum sterilizing course is selected, the steam is sprayed into the drum 400 in a state no laundry is introduced to the drum 400, to sterilize an inside of the drum 400. As shown in FIG. 8, the main selection unit 810 is rotated for selection of a course, and the manual selection unit 820 and the sub-selection unit 830 may be of button types. An 'A' portion in the main selection unit 810 illustrates courses of steam spray.

The sub-selection unit 830 enables to select a sub-function according to the course selected at the main selection unit 810. In detail, if the user selects a steam course in which the steam is sprayed, the sub-selection unit 830 may have a steam time selection unit 832 and a steam period selection unit 834 for controlling a steam time, and a steam supply time period. In addition to this, in a case the user selects a steam course at the main selection unit 810, it is preferable that the sub-selection unit 830 further includes a superheated steam selection course 836 for controlling whether the superheated steam is used or not in the steam course.

That is, if the user selects one course from the steam courses A at the main selection unit 810, and selects the superheated steam at the sub-selection unit 830, the superheated steam is sprayed according to the selected course and a spray condition defined as the default. In this case, it is natural that the superheated steam spray time period and time can be controlled at the steam time selection unit 832 and the steam time period selection unit 834.

The operation of the washing machine in accordance with a preferred embodiment of the present invention will be described.

The user introduces clothing and the like intends to wash to the washing machine, selects a course, and presses an operation button to put the washing machine into operation. In this case, the user may select one of the steam course for spraying steam at the main selection unit 810, and an amount and time of steam or spray of the superheated steam at the sub-selection unit 830. A case will be described, in which the user selects one of the steam course at the main selection unit 810 and spray of the superheated steam at the sub-selection unit 830.

When the user puts the washing machine into operation, the washing water and the detergent are mixed and introduced to the drum 400, and, at the same time with this, the steam generating unit 610 and the reheating unit 650 or 1650 of the steam generator 600 are turned on to supply the superheated steam to the drum 400 through the tub 300. In this case, because the superheated steam is sprayed by the fan 1680 in the reheating unit 1650, the superheated steam is sprayed at a comparatively high speed, to be brought into contact with the clothing uniformly.

Accordingly, as the superheated steam is supplied tot the drum 400 at an initial stage of the washing, to make soaking and separation of contaminants smooth, the washing effect can be enhanced with a small amount of washing water, and sterilize microbes, such as fungi of athlete's foot, fungi, and the like before the washing is progressed. In the meantime, as the fan 520 and the drying heater 510 are turned on to supply the hot air to the drum 400 together with the superheated steam, a temperature of the drum 400 is elevated and the washing water is heated, enabling fast and effective soaking of the laundry and separation of the contaminants.

Upon finish of the washing, rinsing and spinning steps are progressed, wherein numbers of rinsing and spinning times are carried out according to data defined as defaults, or user's manual input. The superheated steam can also be sprayed in the rinsing and the spinning steps. If the superheated steam is sprayed in the rinsing and spinning steps, the laundry sterilizing effect can be enhanced along with the superheated steam sprayed at the initial stage of the washing.

If the drying course of the washing machine is started after finish of the rinsing and the spinning steps, power is applied to the drying heater 510 in the drying duct 500 and the fan 520 is turned on, to generate hot air in the drying duct 500 and supply the hot air to the drum. At the same time with this, the steam generating unit 600 is turned on, to generate the superheated steam, and the superheated steam is supplied to the drum 400 through the tub 300. The hot air and the superheated steam generated and introduced to the drum 400 thus dry the laundry and, at the same time with this, sterilize the laundry.

That is, in the drying course of the laundry, as the hot air and the superheated steam are introduced to the drum 400, the temperature of the drum 400 rises quickly. According to this, the laundry held in the drum 400 is dried more quickly, and fungi of athlete's foot and fungi are sterilized perfectly by the superheated steam, thereby permitting to provide a refresh effect of the laundry.

If the steam generator 600 is in operation in the washing course, rinsing and spinning courses, or the drying course of the washing machine, it is preferable that the drum 400 is rotated for supplying the steam or the superheated steam generated at the steam generator 600 to the laundry, uniformly.

In the meantime, in the steps described before, it is described that the superheated steam is sprayed as a result of selection of the superheated steam at the sub-selection unit 830, and, if the superheated steam is not selected at the sub-selection unit 830, not the superheated steam, but the general 100° C. steam is sprayed. That is, by turning on, not the heater 660 or 1670 of the reheating unit 650, but the steam generating unit 610 of the steam generator 600 only, the general steam is supplied.

Another embodiment of the steam generator will be described.

The foregoing embodiment suggests the steam generating unit 610 having a steam chamber and the reheating unit 650 having a superheated steam chamber are mounted in housings independent from each other. Therefore, because a system for securing the housings to the cabinet is required, there can be additional manufacturing steps required. Along with this, since a path for moving the steam from the steam chamber to the superheated steam chamber can be elongated, there is high possibility of steam condensation which causes heat loss. Those matters can cause a problem of securing a space for mounting the steam generator in the cabinet.

The embodiment suggests a steam generator having a steam chamber and a superheated steam chamber put together.

The embodiment will be described with reference to FIGS. 2, and 9 to 11.

By modifying a structure of the steam generating unit 610 shown in FIG. 2, the steam chamber for generating the steam and the superheated steam chamber for generating the superheated steam can be mounted in one housing 612. That is, an expanded space is formed by projecting a portion of a top side of the housing 612 upward, for using the expanded space as the steam chamber.

Figure 9:
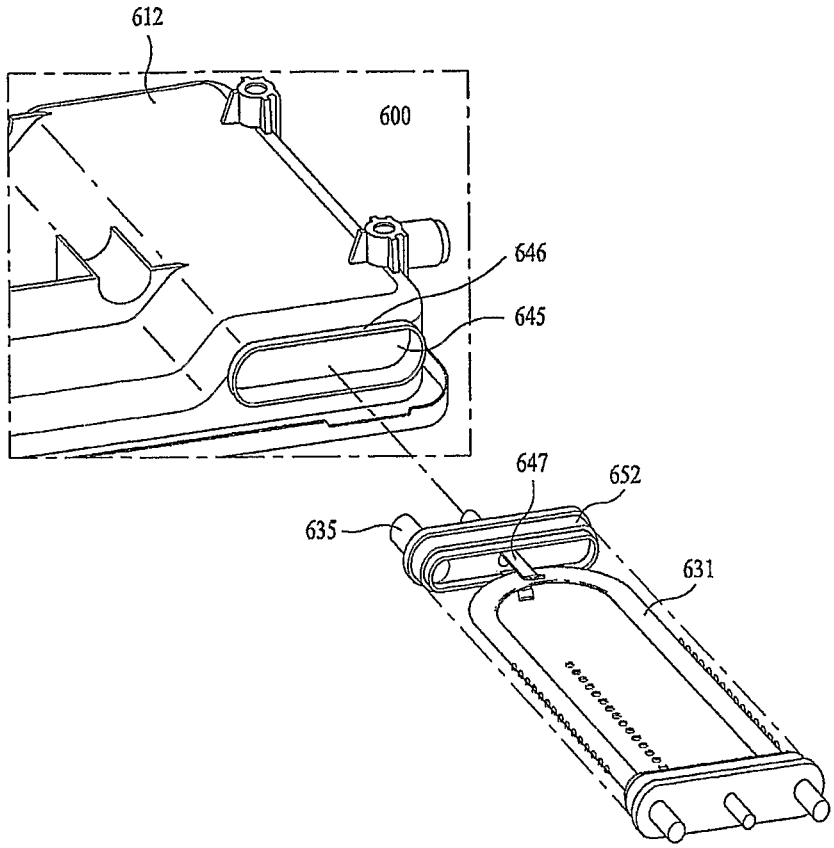
FIG. 9 is an exploded perspective view illustrating a portion of a steam generator in accordance with another preferred embodiment of the present invention.

FIG. 9 is an exploded perspective view illustrating the expanded space formed on an upper side of a right side of the steam generating unit 610 in FIG. 2. Accordingly, one housing of the steam generating unit 610 is used for fabricating a steam generating unit 610 that can generate the steam, and generate the superheated steam, selectively.

The water is heated by the heater 630 in the housing 612 to generate the steam. The steam moves upward and is introduced to the superheated steam chamber 645. Then, the steam is reheated by the heater 631 at the superheated steam chamber 645, to turn into the superheated steam.

Figure 10:
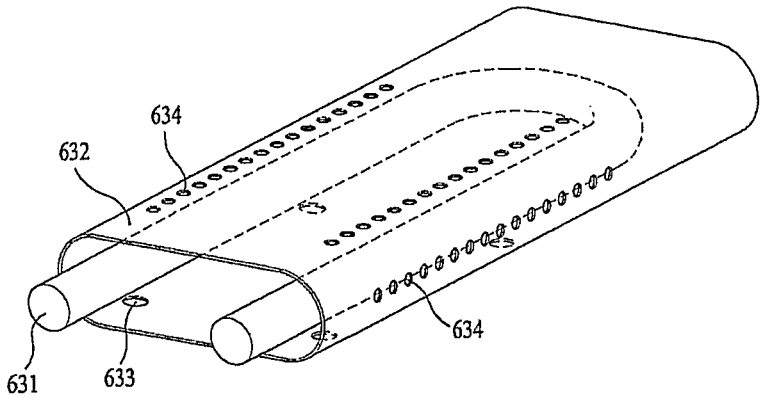
FIG. 10 is a partial perspective view illustrating the superheat chamber in FIG. 9.
Figure 11:
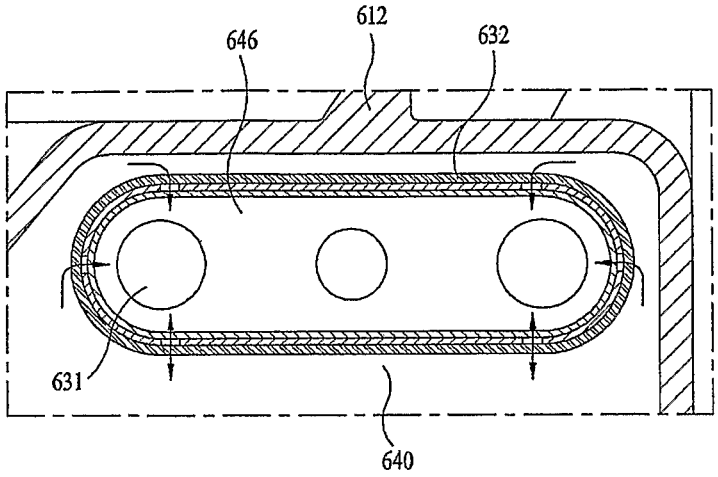
FIG. 11 is a sectional view illustrating a portion of the steam generator in FIG. 9.

In this instance, the superheated steam chamber 645 can be a portion of the steam chamber 640. However, it is preferable that the superheated steam chamber 645 has an outer wall 632 so that the superheated steam chamber 645 can heat exchange with the heater 631 which reheats the steam for a longer time period. That is, as shown in FIGS. 9 to 11, it is preferable that the heater 631 is not simply located on an upper side of the housing 612, but the superheated steam chamber 645 is separated from the steam chamber 640 by the outer wall 632. Of course, it is preferable that the heater 631 is mounted in the superheated steam chamber surrounded by the outer wall 632.

In the meantime, referring to FIG. 11, it is preferable that the outer wall 632 which forms the superheated steam has a gap from an inner wall of the housing 612. That is, it is preferable that the space the superheated steam is generated therein is not in contact with the housing 612 directly so that the steam presents in the gap to transfer only heat of the steam, but not heat of the superheated steam, to the inner wall of the housing, i.e., for obtaining an effect of an heat insulation effect of the steam. According to this, design and material of the housing 612 will be adequate as far as the design and the material are suitable for generation of the steam, and are not required to change the design and the material for the superheated steam, additionally.

Arrows in FIG. 11 show directions of the steam flow into the superheated steam chamber 645, and the superheated steam can be introduced into the superheated steam chamber 645 through drain holes 633.

It is preferable that the outer wall 632 had a plurality of pass through holes 634 for introduction of the steam into the superheated steam chamber 645. It is preferable that the pass through holes 634 are located adjacent to the heater 631 in the superheated steam chamber 645.

That is, as the steam is introduced to a heater part that generates heat, heat transfer can be made more effectively. According to this, direct discharge of the steam introduced to the superheated steam chamber through an outlet 635 without heat transfer can be minimized.

In more detail, referring to FIG. 10, if the heater 631 is adjacent to opposite sides and upper and lower sides of the outer wall, it is preferable that the pass through holes 634 are located adjacent to the opposite sides and the upper and lower sides of the outer wall.

The outer wall may have the drain holes 633 on a lower side for draining water from the superheated steam chamber 645. Of course, the steam can flow into the superheated steam chamber through the drain holes. Therefore, it is preferable that the drain holes are located adjacent to the heater 631.

For an example, if the steam generator is turned off, the steam and/or the superheated steam in the superheated steam chamber can be condensed. According to this, water can be formed in the superheated steam chamber which induces the steam or the superheated steam to condense. When the steam generator is turned on again to generate the steam and to turn the steam into the superheated steam, because the heater have to heat the water in addition to heating again, heat efficiency can not but low at an initial stage of the steam generator being turned on again. Therefore, it is preferable that the drain holes 633 are formed in the superheated steam chamber so that no water is held in the superheated steam chamber.

In the meantime, it is preferable that the housing 612 has fastening holes 651 for locating the heater 631 and the outer wall 632 which forms the superheated steam chamber 645 in the housing.

Referring to FIG. 9, the fastening holes 651 can be formed only on one side of the housing or opposite sides of the housing. A seal may be provided for sealing the fastening holes 651, and a bracket 653 may be provided for fastening the heater 631.

Figure 12:
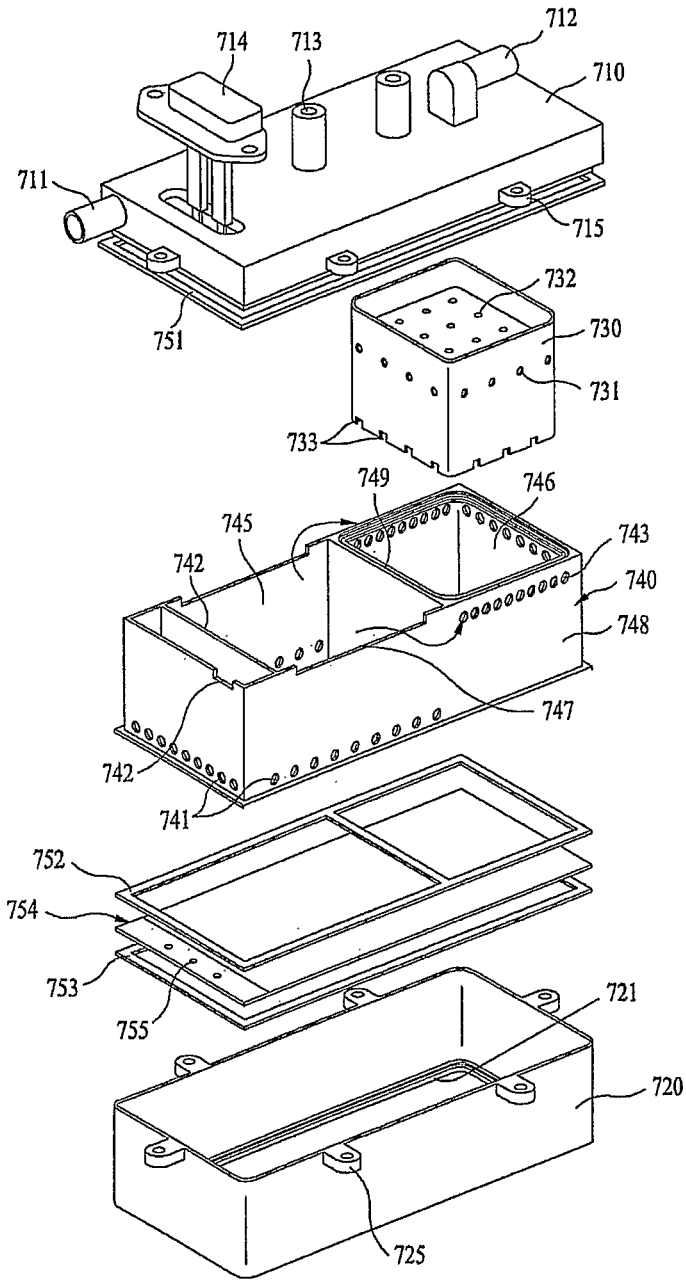
FIG. 12 is an exploded perspective view illustrating a portion of a steam generator in accordance with another preferred embodiment of the present invention.
Figure 13:
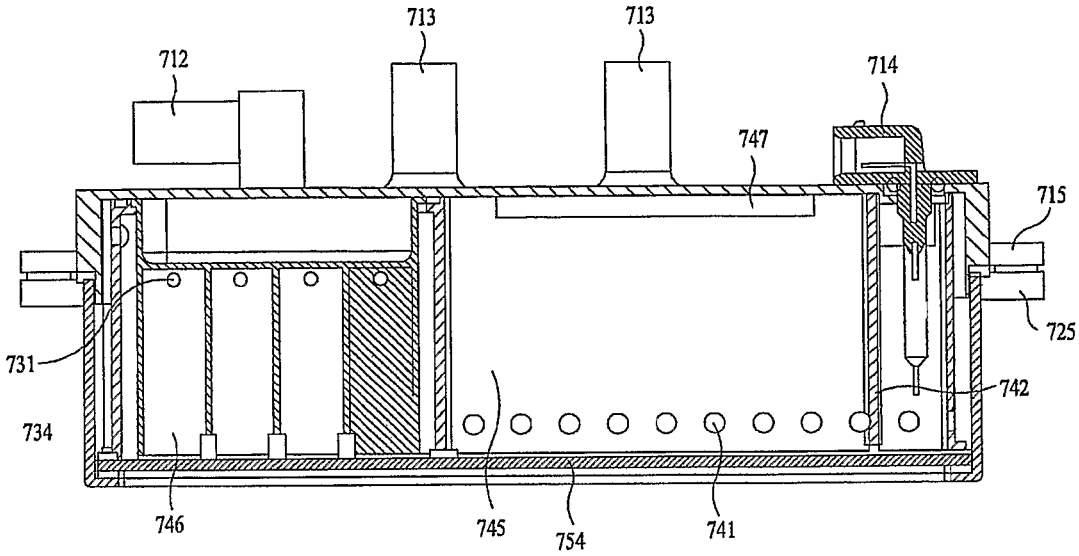
FIG. 13 is a sectional view illustrating the steam generator in FIG. 12.

Another embodiment of the steam generator will be described with reference to FIGS. 12 and 13.

The embodiment also suggests a steam chamber and a superheated steam chamber provided within one housing.

The steam generator 700 has a housing which forms an exterior thereof including an upper housing 710 and a lower housing 720. A steam chamber 745 for generating the steam and a superheated steam chamber 746 for generating the superheated steam may be arranged side by side in the housing. That is, the steam chamber 745 and the superheated steam chamber 746 are positioned side by side horizontally. That is, by arranging, not in up/down direction, but in lateral direction, a height of the steam generator can be reduced.

In the meantime, a partition assembly 740 may be provided, which is provided between the upper housing 710 and the lower housing 720 to form the steam chamber 745 and the superheated steam chamber 745, actually. The partition assembly 740 may have an outer wall 748, and opened top and bottom. Of course, the partition assembly 740 may be fabricated as one unit.

The partition assembly 740 has a chamber partition 749 which partitions the steam chamber 745 and the superheated steam chamber 746, and may have sensor partition 742 which partitions the steam chamber 745. The sensor partition 742 forms a space for surrounding a portion a water level sensor 714 is located therein for minimizing variation of a water level. The sensor partition 742 partitions the steam chamber 745, not perfectly, but water in the steam chamber is in communication with the space through a lower side of the partition 742. Along with this, the steam chamber 745 is also in communication with the space through pass through holes 741 in the outer wall 748. In the meantime, if the water is filled in the steam chamber 745 to a certain extent, for filling up the water in the steam chamber 745, it is required that air is discharged from a top side of the space where the water level sensor 714 is. For this, it is preferable that a vent hole 742' is formed in a top of the outer wall for venting the air.

A heater 754 is mounted on an underside of the partition assembly 740. Seals 752 and 753 are provided on a top side and a underside of the heater 754. The lower seal 753 is in close contact with a step 721 on the lower housing 720 for preventing the steam, the superheated steam, and the water from leaking from the steam chamber and the superheated steam to an outside of the steam generator. Along with this, the lower seal 753 prevents the heater 754 from being in direct contact with the lower housing 720 for preventing the housing from overheating.

It is preferable that the lower housing 720 has an opened bottom for exposing a lower side of the heater 754 to air to prevent the heater from overheating.

The upper seal 752 between the partition assembly 740 and the heater 754 to prevent the partition assembly 740 from being in direct contact with the heater 754 for preventing the partition assembly 740 from overheating. Of course, the upper seal 752 also prevents the steam, the superheated steam, and the water from leaking from the partition assembly 740.

Figure 14:
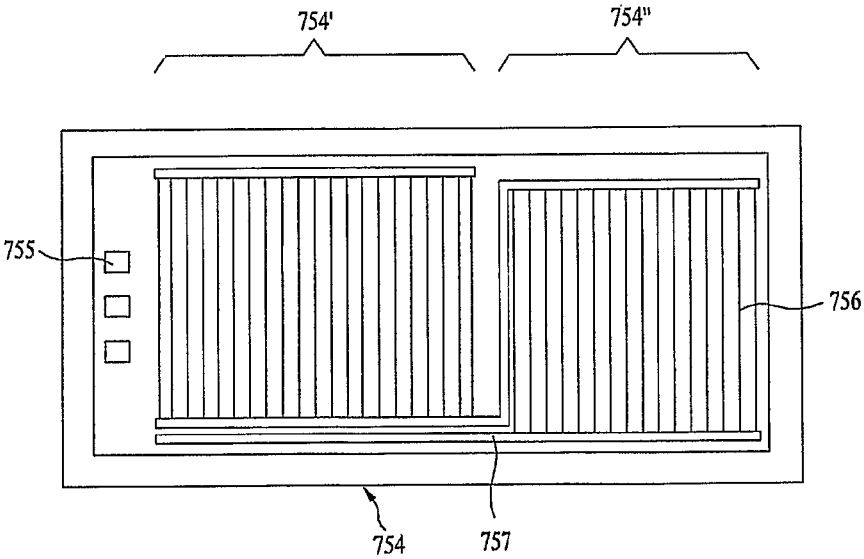
FIG. 14 is a plan view illustrating the heater in FIG. 12.

Referring to FIG. 14, the heater 754 may be single heater. For an example, the heater 754 may be a plate heater of one plate. The plate heater has hot wires 756 having a portion 754' for generating the steam and a portion 754" for generating the superheated steam. That is, as shown in FIG. 14, a left portion is for generation of the steam, and a right portion is for generation of the superheated steam.

In the meantime, as described before, it is preferable that the steam chamber 745 and the superheated steam chamber 746 are controlled to be heated independently. For this, the heater 754 may have three contact points 755. If single phased power is used, it is required that a plus terminal of the power is connected to a starting terminal of the hot wire and a minus terminal of the power is connected to an end of the hot wire for the heater to generate heat. According to this, hot wires for a steam chamber portion and hot wires for a superheated steam chamber portion of the heater may be connected to the minus contact points of the power in parallel, and hot wires for the steam chamber portion and hot wires for the superheated steam chamber portion of the heater may be connected to the plus contact point of the power, selectively.

The hot wires may be placed on an upper surface of the plate of the heater, and an electric pattern 757 may be formed for electric connection of the hot wires. Therefore, as shown in FIG. 14, by connecting a middle portion of the electric pattern to the contact point in default, and upper and lower portions of the electric pattern to contact points different from each other selectively, the hot wires at a particular portion can be made to generate heat, or the hot wires at all portions can be made to generate heat.

That is, it the hot wires at the steam chamber portion is connected to the plus contact point, the steam is generated, and, together with this, if the hot wires at the superheated steam chamber portion is connected to the other plus contact point, the superheated steam will be generated. Of course, as described before, since a quantity of heat required for generating of the steam is greater than a quantity of heat required for generating the superheated steam, it is required that an arrangement of the hot wires and a number of the hot wires are designed appropriately according to capacities of the steam and the superheated steam intended to generate.

In the meantime, the steam generated at the stem chamber 745 tends to rise. Therefore, as shown in FIG. 12, the steam rises in the steam chamber 745, moves along the arrows through the steam outlet holes 747, and introduced into the superheated steam chamber 746. That is, the steam is introduced to the superheated steam chamber 746 through the steam inlet holes 743. Therefore, for smooth introduction of the steam, it is preferable that the steam inlet holes 743 are formed in a top of the partition assembly 740.

In this instance, since the steam tends to rise, the steam has a property not to move toward the superheated steam chamber 746 having a heater mounted therein. Therefore, heat exchange efficiency can be dropped. In order to prevent this, it is preferable that the superheated steam chamber 746 has a heat exchanger 730.

The heat exchanger 730 may have a system for making heat exchange between the steam and the heater for itself, or a system for guiding the steam near to the heater, i.e., the superheated steam chamber 746.

The heat exchanger 730 has steam holes 731 in upper side of an outer wall for introduction of the steam thereto. The steam introduced to the superheated steam chamber 746 is introduced to the heat exchanger 730. For smooth introduction of the steam, it is preferable that a plurality of the steam holes 731 are formed along a circumference of the heat exchanger.

The steam introduced through the steam holes 731 heat exchanges with the heater 754 in the superheated steam chamber 746 along a partition 734 therein, moves up and discharged through a superheated steam outlet hole 743. The superheated steam is discharged from the steam generator 700 through an outlet 712.

That is, the heat exchanger 730 the steam introduced therein guides downward, makes the steam to heat exchange with the heater, and guides superheated steam generated at this time to upward. For this, there may be the partition 734 in the heat exchanger for guiding flows of the steam and the superheated steam. Of course, in conformity with the plurality of steam inlet holes 731, a plurality of holes may be formed in the partition 734, too.

In the meantime, in a lower side of the heat exchanger 730, communication holes or communication slots 733 may be formed for making the inside and outside of the heat exchanger in communication. The communication slots 733 enables the steam or the superheated steam in the heat exchanger to circulate, to enhance heat exchange efficiency and enables to generate good quality superheated steam.

As described before, the steam generator 700 includes the upper housing 710 and the lower housing 720. Therefore, the water is introduced into the housing and the steam or the superheated steam is discharged to the outside of the housing, selectively.

For flow-in/out of the fluid, the upper housing 710 has a water supply hole 711 for introduction of the water thereto. The upper housing 710 has the outlet 712 for discharging the steam or the superheated steam.

In the meantime, between the upper housing and the lower housing, there is a seal 715 for preventing the water, the steam, or the superheated steam from leaking. Accordingly, the seal 715 is compressed when the upper housing 710 and the lower housing 720 are joined, to seal between the two.

The upper housing 710 and the lower housing 720 can be joined together with flanges 715 and 725 formed on the upper housing 710 and the lower housing 720. Of course, though the upper housing 710 and the lower housing 720 can be joined with hooks, vibration, or thermal fusion, because an inside system of the steam generator is complicate, after placing the inside system in the lower housing 720, the upper housing and the lower housing can be joined with screws or bolts, or so on, simply.

The upper housing 710 may have securing pieces 713 on a top for securing the steam generator to an inside of the case 100. Though the securing pieces 713 may have various shapes, the steam generator 700 having a single housing can be secured with such securing pieces 713, easily.

That is, with the steam generator having the single housing, since the steam and the superheated steam can be generated selectively, and along with this, the steam generator can be secured easily, fabrication process can be minimized.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

In the meantime, in describing embodiments of the present invention, though a washing machine is described as an example of the clothing treating apparatus, the clothing treating apparatus of the present invention is not limited to this. The clothing treating apparatus of the present invention can be, starting from the washing machines, dryers, and washing and drying machines, and refreshers.

For an example, the dryer supplies the steam and the hot air to the drum selectively while rotating the drum for progress of a drying course. In this case, the steam may be the superheated steam, sprayed before or after the drying course. Because the dryer has a structure similar to the washing machine except that the dryer requires no water supply means to the tub and the drum, detailed description of the dryer will be omitted.

If the clothing treating apparatus is the refresher, no rotating drum is required, but a clothing holding space is adequate. Even in the case of the refresher too, because the steam generator has a system similar to the steam generators of other clothing treating apparatuses described before, detailed description of the refresher will be omitted.

The invention claimed is:

1. A washing machine comprising:

a cabinet;

a tub having a hot air inlet and a hot air outlet;

a drying duct forming a flow passage between the hot air inlet and the hot air outlet;

a drying heater provided in the drying duct for heating air flowing along the drying duct;

a drum provided in the cabinet for accommodating cloth;

a flow passage for supplying washing water to the tub; and a steam generator selectively generating steam or superheated steam to supply to the drum, wherein the steam generator includes; a steam chamber which forms a space for heating water to generate the steam, and a superheated steam chamber which forms a space for reheating the steam to generate the superheated steam, and wherein the steam chamber includes a steam heater and the superheated steam chamber includes a superheated steam heater for heating steam, wherein the washing machine further comprises a first pipe provided between the superheated steam chamber and the drum.

2. The washing machine as claimed in claim 1, wherein the steam generator and the flow passage are opened in a direction the steam or the superheated steam is supplied to the drum.

3. The washing machine as claimed in claim 1, wherein the steam generator further includes:

a housing having an inlet for introduction of water thereto for generating the steam, wherein the steam chamber and the superheated chamber are disposed in the housing.

4. The washing machine as claimed in claim 3, wherein the superheated steam chamber is provided on an upper side of the inner space of the steam chamber.

5. The washing machine as claimed in claim 4, wherein the steam heater is provided in an inside space of the steam chamber, and the superheated steam heater is provided in an inside space of the superheated steam chamber, respectively.

6. The washing machine as claimed in claim 5, wherein the superheated steam chamber has an outer wall which separates the superheated steam chamber from the steam chamber.

7. The washing machine as claimed in claim 6, wherein the outer wall of the superheated steam chamber has a long side arranged with a gap from an inner wall of the housing.

8. The washing machine as claimed in claim 6, wherein the outer wall of the superheated steam chamber have a portion adjacent to the superheated steam heater with a plurality of communication holes formed therein for introduction of the steam.

9. The washing machine as claimed in claim 3, wherein the housing has at least one fastening hole for placing in and fastening the superheated steam chamber thereto.

10. The washing machine as claimed in claim 3, wherein the steam chamber and the superheated steam chamber are arranged side by side in a horizontal direction.

11. The washing machine as claimed in claim 10, further comprising a heat exchanger in the superheated steam chamber.

12. The washing machine as claimed in claim 11, wherein the heat exchanger guides the steam introduced to a upper side of the superheated steam chamber to a lower side of the superheated steam chamber, and guides the steam to an upper side of the superheated steam chamber again.

13. The washing machine as claimed in claim 1, further comprising a second pipe provided between the steam chamber and the superheated chamber.

14. The washing machine as claimed in claim 13, wherein the steam chamber and the superheated steam chamber are spaced from each other, and connected with the second pipe.

15. The washing machine as claimed in claim 14, wherein the superheated steam chamber is formed at one end of the second pipe.

16. The washing machine as claimed in claim 15, further comprising a fan mounted to the superheated steam chamber or the first or the second pipe for flow of the steam or the superheated steam.

17. The washing machine as claimed in claim 14, wherein the superheated chamber is adjacent to the drum between the steam chamber and the drum.

18. The washing machine as claimed in claim 1, further comprising a water supply hose between the steam chamber and a water supply source.

19. The washing machine as claimed in claim 13, further comprising a water softening unit at the second pipe filtering water supplied to the steam chamber.

* * * * *